US005379092A

United States Patent [19]

Takashima

[11] Patent Number: 5,379,092

[45] Date of Patent: Jan. 3, 1995

[54] IMAGE FORMING APPARATUS WITH CASING LATCHING AND OPENING FEATURE

[75] Inventor: Kazunori Takashima, Kamakura, Japan

[73] Assignee: Canon Kabushiki Kaisha, Tokyo, Japan

[21] Appl. No.: 79,746

[22] Filed: Jun. 22, 1993

[30] Foreign Application Priority Data

Jun. 25, 1992 [JP] Japan ..... 4-190229

[51] Int. Cl.[6] ..... G03G 15/00

[52] U.S. Cl. ..... 355/200; 312/324; 355/245

[58] Field of Search ..... 355/200, 210, 245, 246, 355/260; 222/DIG. 1; 312/325, 324, 302, 298, 300, 322; 354/288, 187

[56] References Cited

U.S. PATENT DOCUMENTS

| | | | |
|---|---|---|---|
| 4,555,173 | 11/1985 | Iseki et al. | 355/200 |
| 4,585,324 | 4/1986 | Koyama et al. | 355/200 |
| 4,641,947 | 2/1987 | Ishida et al. | 355/200 |
| 4,748,481 | 5/1988 | Kunihiro | 355/133 |
| 4,814,817 | 3/1989 | Nishijima et al. | 355/200 X |
| 5,027,152 | 6/1991 | Oda et al. | 355/200 |
| 5,126,788 | 6/1992 | Koga | 355/200 |
| 5,305,065 | 4/1994 | Hoover et al. | 355/285 |

*Primary Examiner*—A. T. Grimley
*Assistant Examiner*—Thu A. Dang
*Attorney, Agent, or Firm*—Fitzpatrick, Cella, Harper & Scinto

[57] ABSTRACT

An image forming apparatus with a casing latching and opening feature includes an openable and closable member forming a part of a casing of the image forming apparatus. When the openable and closable member is closed in opposition to the biasing force of the biasing device for biasing the openable and closable member in a direction in which it is open and the biasing force of a latching or locking device, the relation $W_{1MAX}-W_{1L}<W_{2MAX}$ is satisfied when the biasing forces of the biasing device and the locking device immediately before the openable and closable member is locked by the locking device are denoted as $W_{1L}$ and $W_{2MAX}$, respectively, and the biasing force of the biasing device at a lock position at which the openable and closable member runs beyond the lock position to be unable to move is denoted as $W_{1MAX}$. Thus, the openable and closable member can be closed with ease.

6 Claims, 17 Drawing Sheets

IMAGE FORMING APPARATUS WITH CASING LATCHING AND OPENING FEATURE

BACKGROUND OF THE INVENTION

1. Field of the Invention

The present invention relates to an image forming apparatus, such as a copying machine or a printer and, more particularly, to an image forming apparatus having an openable and closable member forming a part of a casing of the image forming apparatus.

2. Description of the Related Art

It is preferable that an image forming apparatus having an openable and closable member forming a part of a casing thereof to be first partially opened by merely pressing a button before it is then fully opened manually to perform maintenance inside of the main body of the apparatus and to relieve jammed recording members. The reason for this two-step operation is that by partially opening the openable and closable member, it is easy for an operator to insert his hand between the openable and closable member and the rest of the casing, making it possible to easily and fully open the openable and closable member.

To form such a construction, biasing means for biasing the openable and closable member in a direction in which it is open, and locking means for latching or locking the openable and closable member to a casing, are required. (For purposes of convenience, the following discussion will use the word "locking and variations thereof to describe preferred embodiments of the disclosed invention") Automatic locking of the openable and closable member to a casing as a result of closing the openable and closable member makes the operation easy. Therefore, it is preferable that the locking mechanism be constructed so as to elastically bias the openable and closable member.

Specifically, as shown in FIG. 15, a lid member 51 (the openable and closable member) is mounted so as to be openable and closable with respect to the main body 50 of the apparatus by means of a shaft 52. A bar 53 is disposed in the lid member 51, and a locking member 54 for locking the bar 53 is disposed in the main body 50 of the apparatus. With this construction, when the lid member 51 is pushed down, causing the bar 53 to be pushed down below the locking member 54, the lid member 51 is locked by the locking member 54 which returns to its original position by the bias of a spring 55.

Also, a push-up member 57 for pushing up the bar 53 by means of the bias of a spring 56 is disposed in the main body of the apparatus. By pushing up the lid member 51 when the locking mechanism is released, a handhold is provided for an operator to open the lid member 51.

Recently in image forming apparatuses, the weight of the lid member 51 has increased as the apparatus has become enlarged and for recording to be performed at a high speed. Also, in some image forming apparatuses, recorded medium is ejected onto the lid member 51. In such a case, the weight of the lid member 51 increases even more. Therefore, it is required that the bias force of the spring 56 connected to the push-up member 57 be increased and the amount of push-up also be increased. However, the bias force of the spring 56 becomes a resistance force when the lid member 51 is closed. The greater the bias force is, the greater the resistance is when the lid member 51 is closed. In particular, when the lid member 51 is locked, even after the bar 53 runs beyond the locking member 54, the bar 53 causes the lid member 51 to be pushed downward even more, causing an overstroke. However, there is a problem in that if the bias force of the spring 56 is large, a large force is required for the overstroke, reducing the ease of opening and closing the lid member 51.

SUMMARY OF THE INVENTION

The present invention has been achieved in view of the above-described problems of the related art.

It is an object of the present invention to provide an image forming apparatus having an openable and closable member, which apparatus can be operated with ease.

It is another object of the present invention to provide an image forming apparatus including a casing, an openable and closable member movable relative to a fixed part of the casing; biasing means for elastically biasing the openable and closable member in a direction in which it is open relative to the fixed part; and locking means for locking the openable and closable member to the casing, the locking means elastically biasing the openable and closable member in a direction in which it is open when the openable and closable member is closed relative to the fixed part of the casing, the openable and closable member being locked at a lock position by the locking means after the openable and closable member is closed in opposition to the biasing force of the biasing means and the biasing force of the locking means, wherein the following relation is satisfied: $W_{1MAX}-W_{1L}<W_{2MAX}$ when the biasing force of the biasing means and the biasing force of the locking means immediately before the openable and closable member is locked by the locking means are denoted as $W_{1L}$ and $W_{2MAX}$ respectively, and the biasing force of the biasing means at a position at which the openable and closable member travels beyond the lock position to be unable to a point where the openable and closable member can no longer travel is denoted as $W_{1MAX}$.

It is yet another object of the present invention to provide an image forming apparatus, including a casing, an openable and closable member movable relative to a fixed part of the casing, biasing means for elastically biasing the openable and closable member in a direction in which it is open relative to the fixed part, the biasing means including a push-out member, latching means for latching the openable and closable member to the casing, the latching means, including a latchable member, and elastically biasing the openable and closable member in a direction it is open when the openable and closable member is closed relative to the fixed part of the casing, and the openable and closable member being latched by the latching means at a latch position after the openable and closable member is closed in opposition to bias forces of the biasing means and the latching means, wherein the following relationship is satisfied:

$$W_{1MAX}-W_{1L}<W_{2MAX}$$

when the push-out force of said push-out member at a position immediately before the latchable member is latched by the latching member is denoted as $W_{1L}$, the push-out force of said push-out member when the latchable member displaced to the end portion of overstroke is denoted as $W_{1MAX}$, and the push-out force at a position immediately before the latchable member is latched by the latching member is denoted as $W_{2MAX}$.

The above and further objects and novel features of the invention will more fully appear from the following detailed description when the same is read in connection with the accompanying drawings. It is to be expressly understood, however, that the drawings are for the purpose of illustration only and are not intended as a definition of the limits of the invention.

DETAILED DESCRIPTION OF THE PREFERRED EMBODIMENT

The first embodiment of the present invention will be explained below in detail with reference to FIGS. 1 to 7 and FIGS. 16 and 17.

Figure 1:
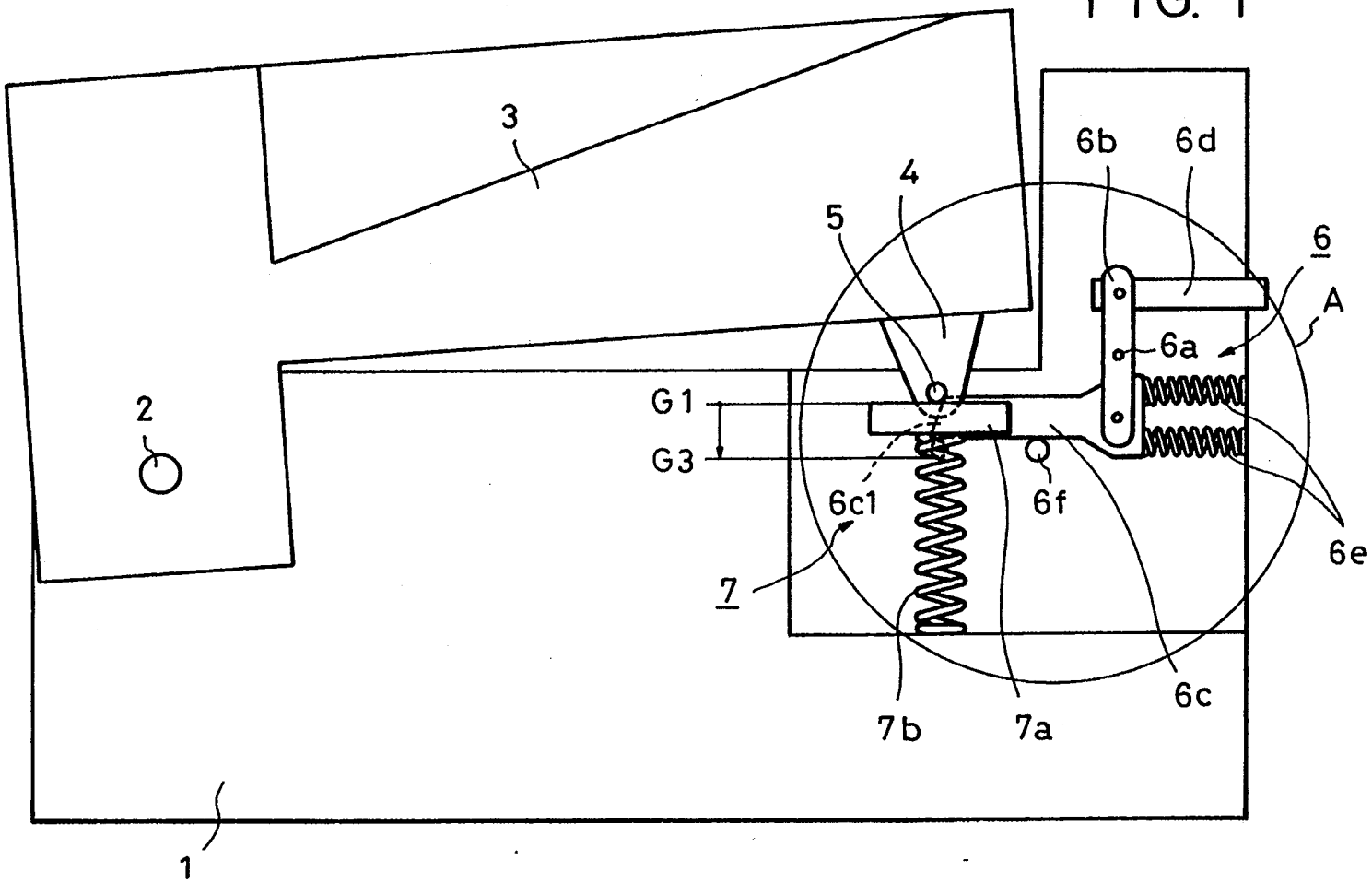
FIG. 1 is a sectional view schematically illustrating a locking mechanism in accordance with a first embodiment of the present invention.
Figure 2:
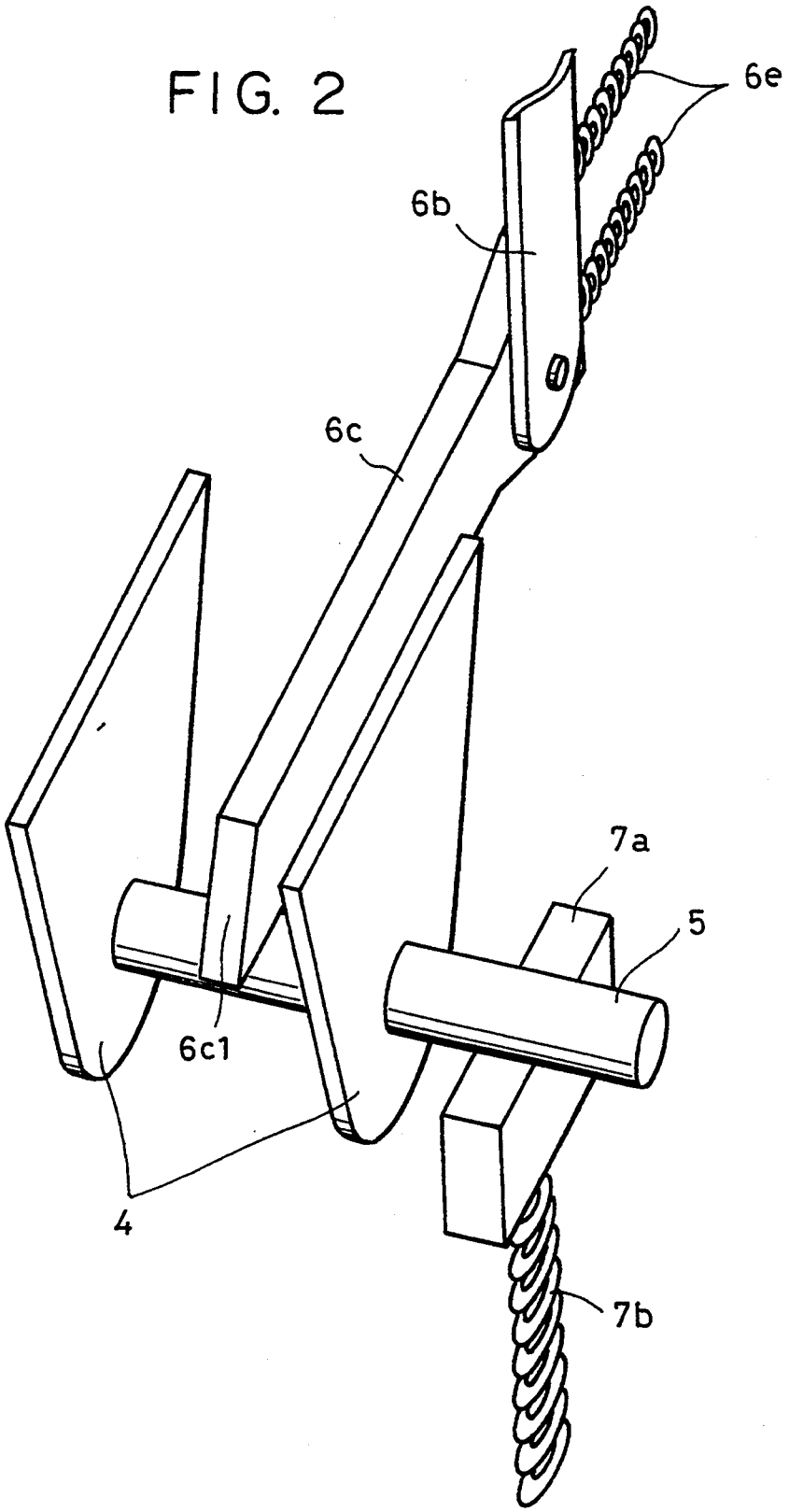
FIG. 2 a perspective view schematically illustrating the locking mechanism.

As shown in and FIGS. 1 and 2, the locking mechanism A is so designed that a second frame 3 (an openable and closable member) is mounted so as to be rotatable with respect to a first frame 1 around a shaft 2. The second frame 3 is openable and closable with respect to the first frame and may be locked in a closed state or the locked state may be released. Two side plates 4 are mounted spaced apart by a fixed distance below the rotary leading edge portion of the second frame 3. A bar-shaped lockable member 5 is mounted in the space between the side plates 4. Locking means 6 for locking the lockable member 5 and biasing means 7 for pushing up the lockable member 5 (elastically biased in a direction in which the openable and closable member is open) are disposed in the first frame 1.

In the first frame 1, a locking member **6*c* of the locking means 6 is mounted at one end of a linking member 6*b* of the locking means 6 which is mounted so as to be rotatable around a shaft 6*a* of the locking means 6. A lock releasing button 6*d* of the locking means 6 is mounted at the other end of the linking member 6*b*. An inclined section 6*c*1, which protrudes downward, is formed in the leading edge portion of the linking member 6*b*. The inclined section 6*c*1 is urged by a pressing spring 6*e* to the left in FIG. 1**. It follows that the locking means elastically biases the openable and closable member in a direction in which the member is open.

The end portion of the lock releasing button **6*d* protrudes from the side of the first frame 1. Depressing the lock releasing button 6*d* causes the linking member 6*b* to rotate in a counterclockwise direction around the shaft 6*a*, and causes the locking member 6*c* to slide to the right in FIG. 1. A support member 6*f* slidably supports the lower end of the locking member 6*c***.

A biasing means 7 biases, by means of a lift spring **7*b*, a push-out member 7*a* for receiving the lower end of the lockable member 5 at substantially the same height as that of the locking member 6*c*. The biasing means 7 pushes up the second frame 3 via the lockable member 5** during the locking and releasing operations.

Next, an explanation will be given of a case in which the second frame 3 is closed and locked to the first frame 1 in the above-described construction.

Figure 3:
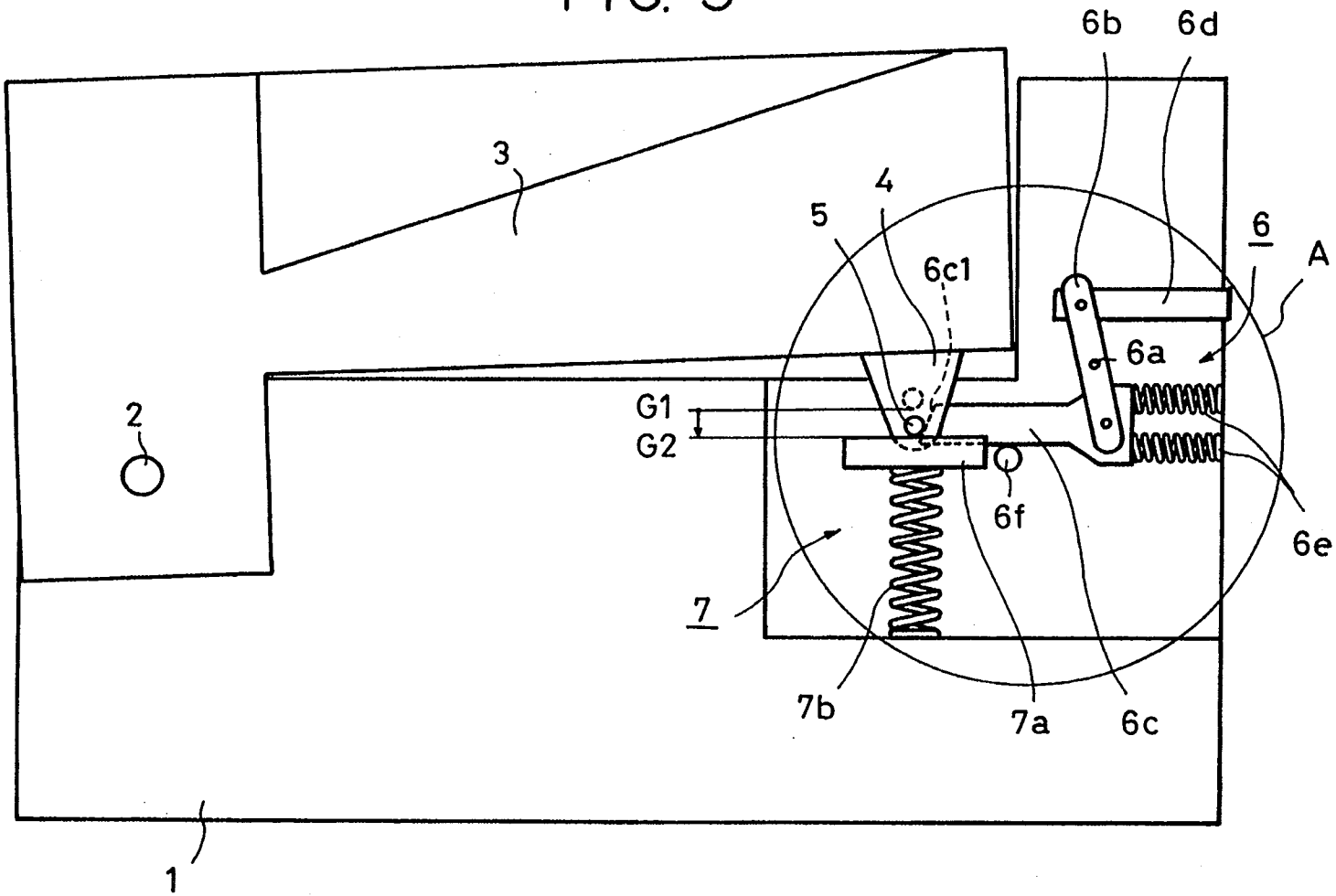
FIG. 3 illustrates a state before a bar is locked by a locking member.
Figure 4:
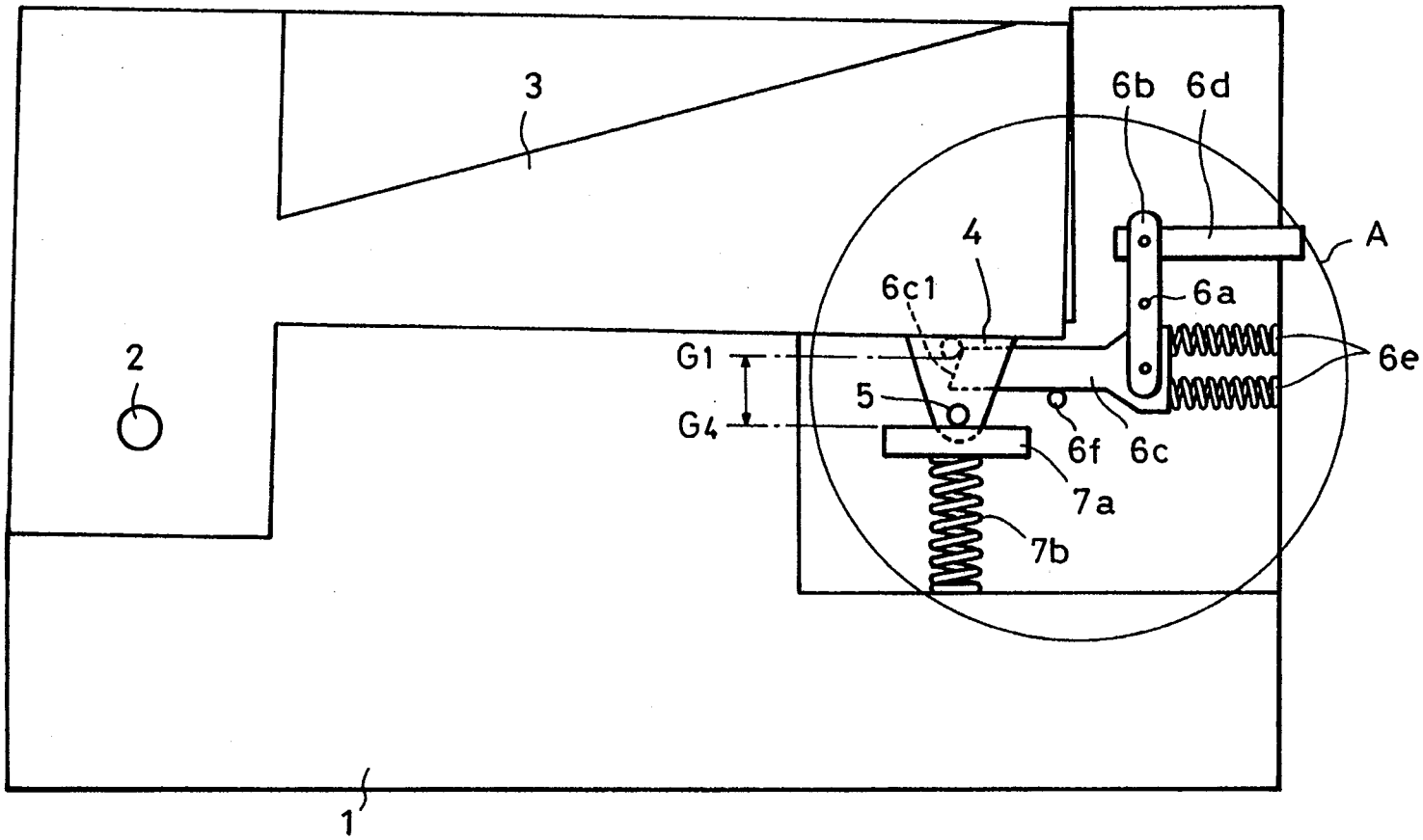
FIG. 4 is a sectional view illustrating an overstroke.
Figure 5:
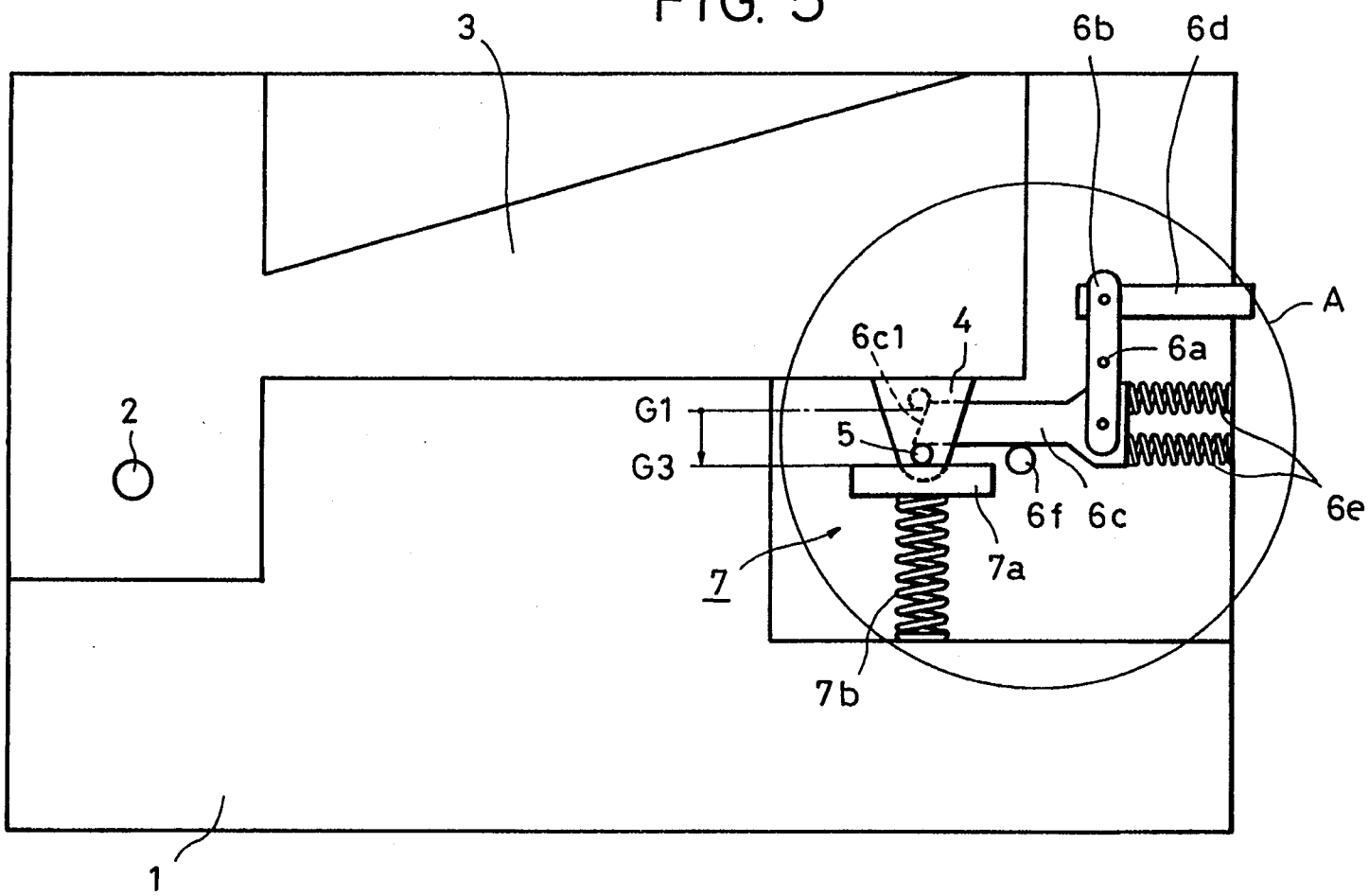
FIG. 5 is an illustration of a locked state.

Initially, as shown in FIG. 1, when the second frame 3 is closed, the lockable member 5 of the second frame 3 rides on the inclined section **6*c*1 of the locking member 6*c* and rides on the push-out member 7*a* (the lockable member 5 is at a position $G_1$). When the second frame 3 is pushed down in this condition, as shown in FIG. 3, the lockable member 5 pushes out the locking member 6*c* to the right along the inclined section 6*c*1 and pushes down the push-out member 7*a* (the lockable member 5 is at a position $G_2$). When the second frame 3 is further pushed down, as shown in FIG. 4, the lockable member 5 overstrokes below the locking member 6*c* by a fixed amount. Also, the locking member 6*c* returns to its original position (i.e., the same position when the openable and closable member is open) by means of the bias of the pressing spring 6*e* (the lockable member 5 is at a position $G_4$). As shown in FIG. 5, stopping the pushing-down of the second frame 3 causes the lockable member 5 to be pushed up by the biasing means 7, and the lockable member 5 is locked to the lower end of the locking member 6*c* at a lock position (the lockable member 5** is at a position $G_3$).

Figure 6:
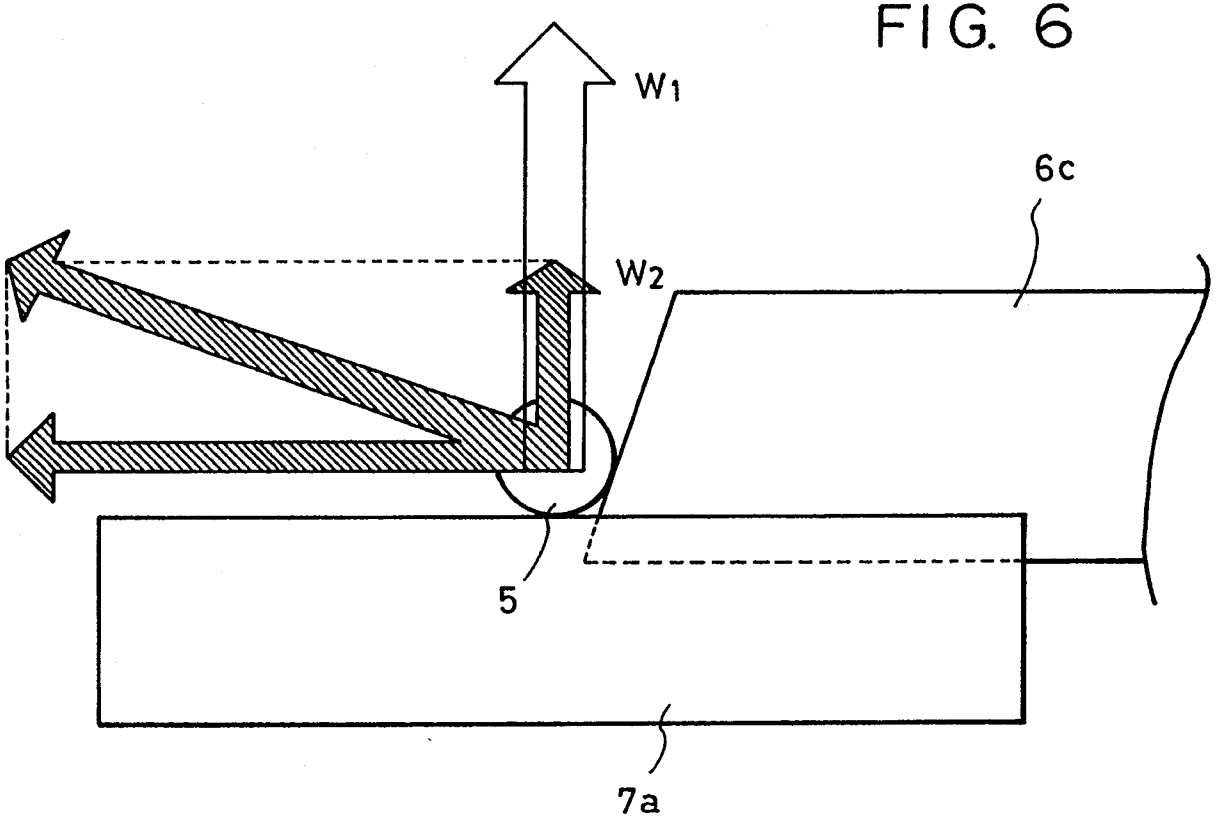
FIG. 6 is an illustration of a push-out force applied to the bar.

At this point, pushing down and locking the second frame 3 is performed in such a way that the lockable member 5 pushes out the locking member **6*c* in opposition to the bias of the pressing spring 6*e* and pushes out the push-out member 7*a* in opposition to the bias of the lift spring 7*b*, as described above. That is, as shown in FIG. 6, a force required to push down the second frame 3 so that the second frame 3 can be locked is a resultant force $W_1+W_2$ of a push-out force $W_1$ by which the lockable member 5 is pushed up by the push-out member 7*a* and a component force $W_2$ (an upward component force as in $W_1$) perpendicular to the push-out force of the locking member 6*c* in a condition in which the lockable member 5 is locked to the locking member 6c and the push-out member 7a. The push-out force of the locking member 6c $W_2$ does not act in an overstroke condition in which the lockable member 5 is positioned below the locking member 6c, and only the push-out force $W_1$ of the push-out member 7a** acts.

Figure 7:
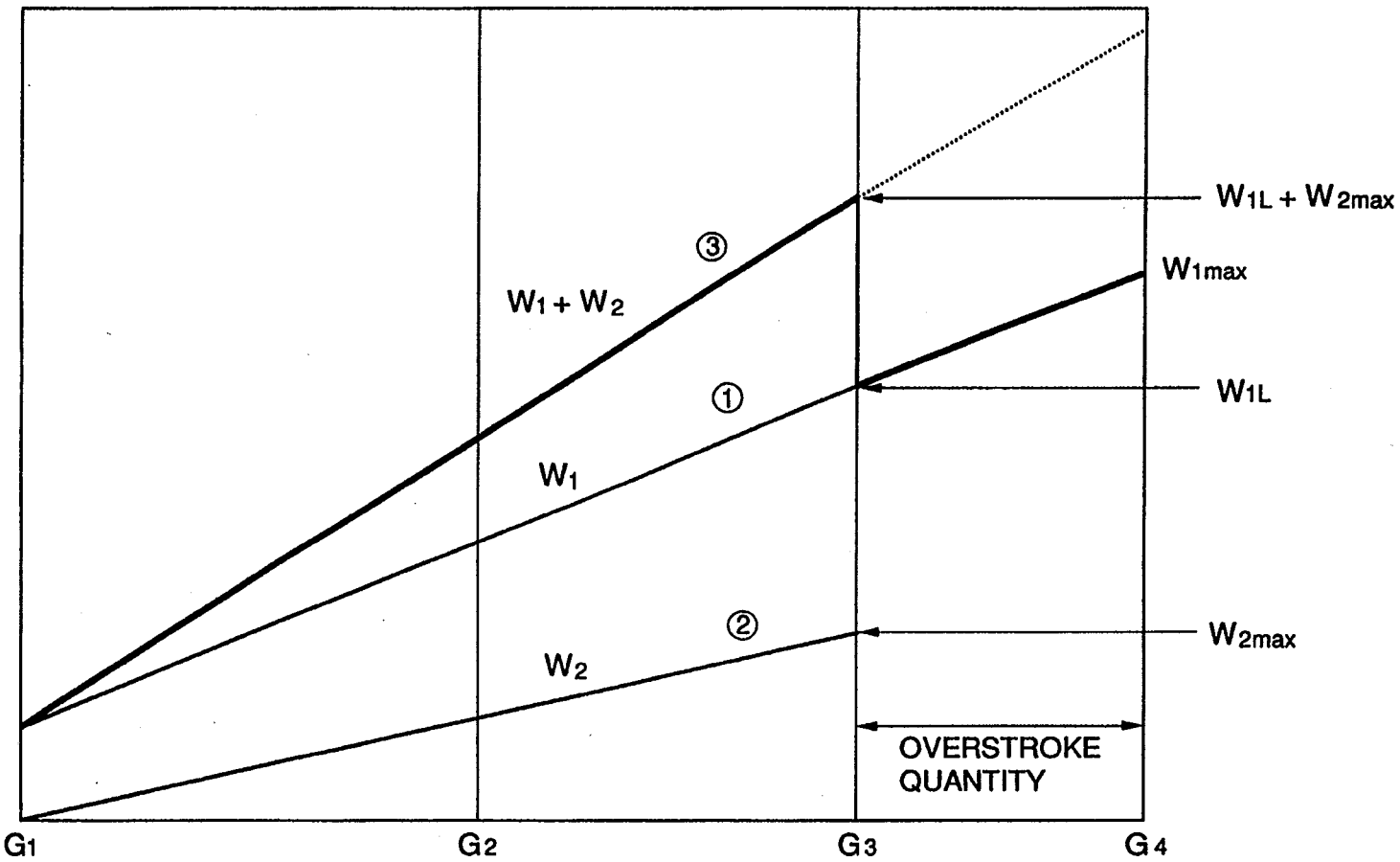
FIG. 7 is a graph illustrating push-out forces applied to the bar.

A specific case will now be explained in which the displacement of the lockable member 5 is plotted on the horizontal axis and the upward push-out force acting on the lockable member 5 is plotted on the vertical axis as shown in FIG. 7. The push-out force $W_1$ by which the lockable member 5 is pushed up by the push-out member 7a varies in proportion to the displacement of the lockable member 5 as in the straight line indicated by ① in FIG. 7. The push-out force of the push-out member 7a at a position immediately before the lockable member 5 is locked by the locking member 6c (immediately before the locking mechanism is released) is denoted as $W_{1L}$. The push-out force by the push-out member 7a when the lockable member 5 displaces to the end portion of the overstroke, that is, at a position at which the openable and closable member runs beyond the lock position and is unable to move, is denoted as $W_{1max}$.

On the other hand, the component force $W_2$ perpendicular to the push-out force of the locking member 6c varies linearly as indicated by ② in FIG. 7. The component force becomes the maximum force $W_{2max}$ at a position immediately before the lockable member 5 is locked by the locking member 6c. In the overstroke condition after the locking of the lockable member 5 and the locking member 6c has been released, the push-out force by the locking member 6c does not occur.

Therefore, in a locking process, the push-out force for pushing up the second frame 3 in a condition shown in FIG. 1 varies as indicated by ③ in FIG. 7. That is, the force is $W_1+W_2$ immediately before the lockable member 5 reaches a position where it is locked, and the force is $W_1$ in an overstroke condition.

A setting is so made that the relation of the push-out forces of the lockable member 5 by means of the locking member 6c and the push-out member 7a becomes $W_{1L+W2max}>W_{1max}$, i.e., $W_{1max}-W_{1L}<W_{2max}$.

With this arrangement, when locking, the force required to push down the second frame 3 reaches a maximum at a position immediately before locking. A force larger than the push-out force at a position immediately before locking is not required in the overstroke condition even when the positional displacement of the lockable member 5 reaches the maximum. Therefore, a small push-out force is required when the second frame 3 is locked to the first frame 1 in addition to it being required for the overstroke condition, thus improving the ease of opening and closing.

When the locking mechanism is to be released, the lock releasing button 6d is depressed to rotate the linking member 6b, causing the locking member 6c to slide, releasing the locking of the locking member 6c and the lockable member 5. Thereupon, the lockable member 5 is pushed up to the position shown in FIG. 1 by the push-out force $W_1$ of the push-out member 7a and the upward component push-out force $W_2$ of the locking member 6c. Therefore, if the push-out force $W_2$ of the locking member 6c is set relatively large, the second frame 3 can be reliably pushed up to the position shown in FIG. 1, even if it is heavy. However, the setting of the push-out force $W_2$ of the locking member 6c to a large value is for the purpose of setting the bias force of the pressing spring 6e at a large value, with the result being that a large force is required to depress the lock releasing button 6d to release the locking mechanism. However, this requirement can be easily solved by increasing the length from the shaft 6a which is a fulcrum around which the shaft 6a rotates to the point of force application by the lock releasing button 6d.

Figure 16:
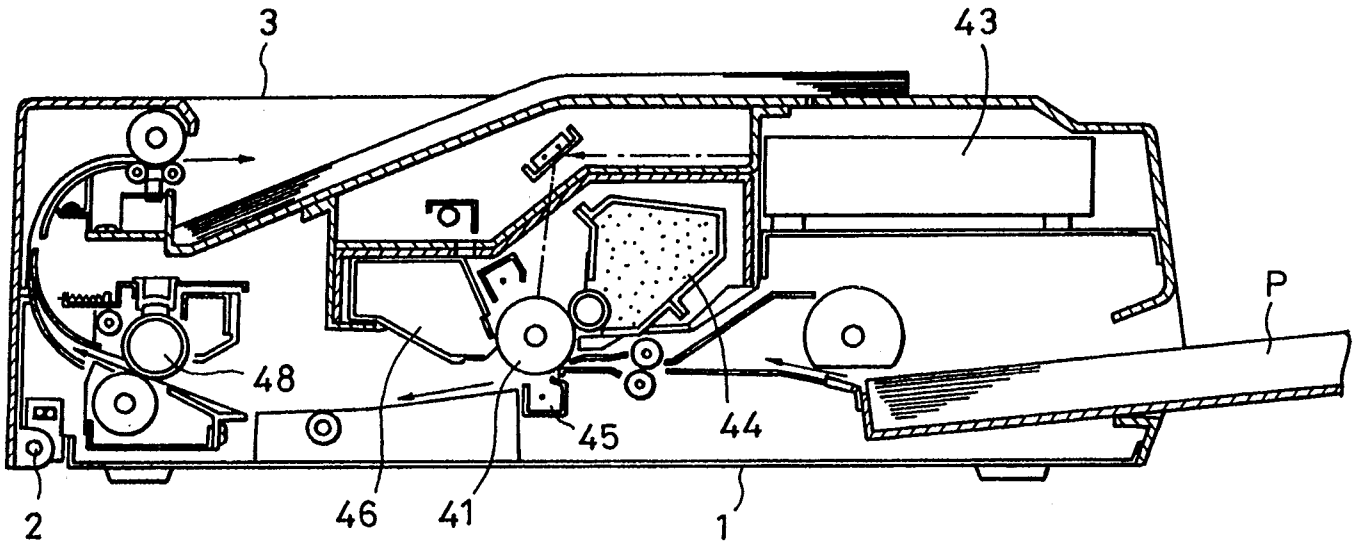
FIG. 16 is a sectional view of an image forming apparatus in accordance with the first embodiment of the present invention.

Next, the image forming apparatus to which the present invention can be applied will be explained with reference to FIGS. 16 and 17.

Figure 17:
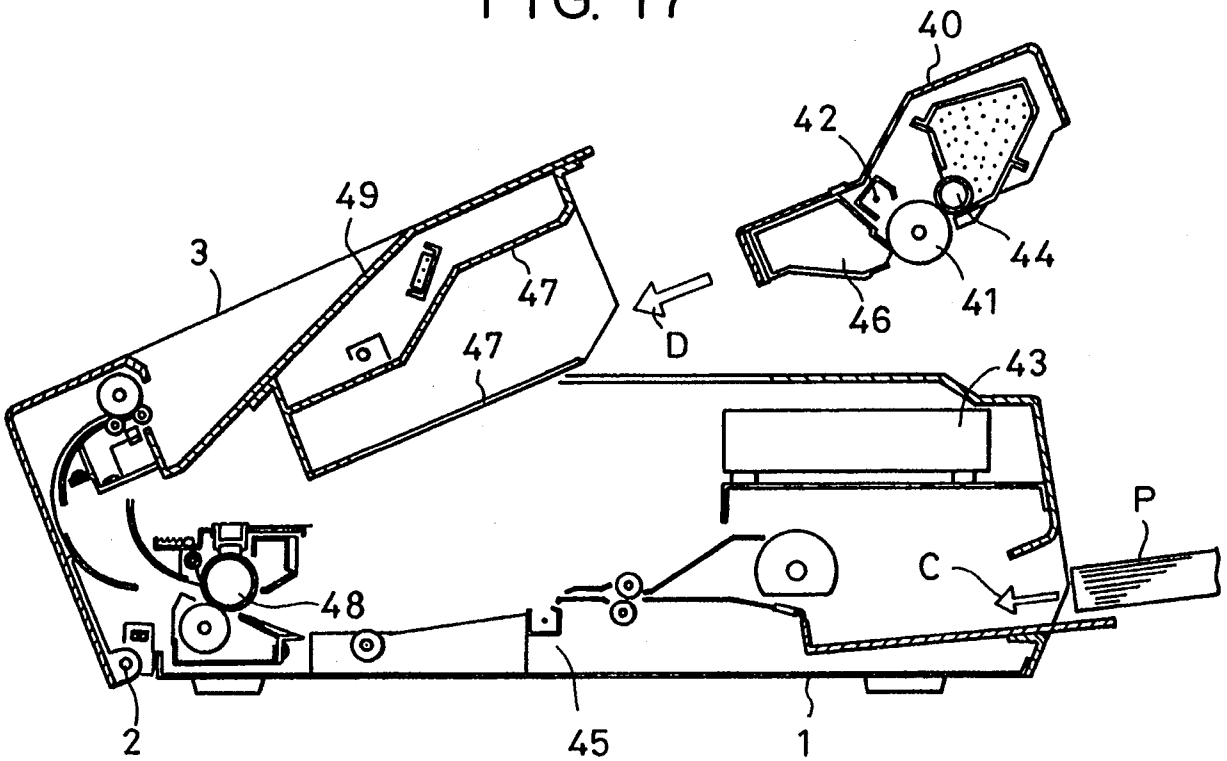
FIG. 17 is a sectional view illustrating the state when a process cartridge for the image forming apparatus of first embodiment of the present invention is loaded.

As shown in FIG. 17, a process cartridge 40 has a photosensitive body 41, a charger 42 for supplying charge to the photosensitive body 41, a developing unit 44 for supplying a developing agent to an electrostatic latent image formed on the photosensitive body 41, and a cleaning unit 46 for receiving residue on the photosensitive body 41. The process cartridge 40 is installed in a process cartridge receiving space 47 formed in the upper frame 3 (the openable and closable member) of the main body of the image forming apparatus from the direction indicated by the arrow D. The upper frame 3 is pivotally attached to the lower frame 3 around shaft 2.

After the process cartridge 40 is installed in the upper frame 3, the upper frame 3 is closed with respect to the lower frame 1 as described above (FIG. 16).

In the process for forming a developing agent image on a recording medium P, first, the photosensitive body 41 is uniformly charged by the charger 42. Next, an image in accordance with image signals from an unillustrated personal computer or the like is exposed on the photosensitive body 41 by an exposure unit 43. A developing agent is supplied to an electrostatic latent image formed in this way from the developing unit 44, thereby obtaining a visible image (a developing agent image). This developing agent image is transferred to a recording medium P transported to a transfer area by means of a transfer unit 45. The developing agent image is fixed onto the recording medium P by making the recording medium P on which a non-fixed developing agent image is carried pass through a pair of fixing rollers 48. Thereafter, the recording medium P bearing the image is ejected onto an ejection tray 49.

Since the process cartridge 40 is mounted on the upper frame 3, the combined weight is relatively large. Therefore, in the present invention, the relation $W_{1max}-W_{1L}<W_{2max}$ is satisfied, making it easy to open and close the lower frame 1 and the upper frame 3 even if the upper frame 3 is heavy.

Next, the second embodiment of the present invention will be explained with reference to FIGS. 8 to 14.

Figure 8:
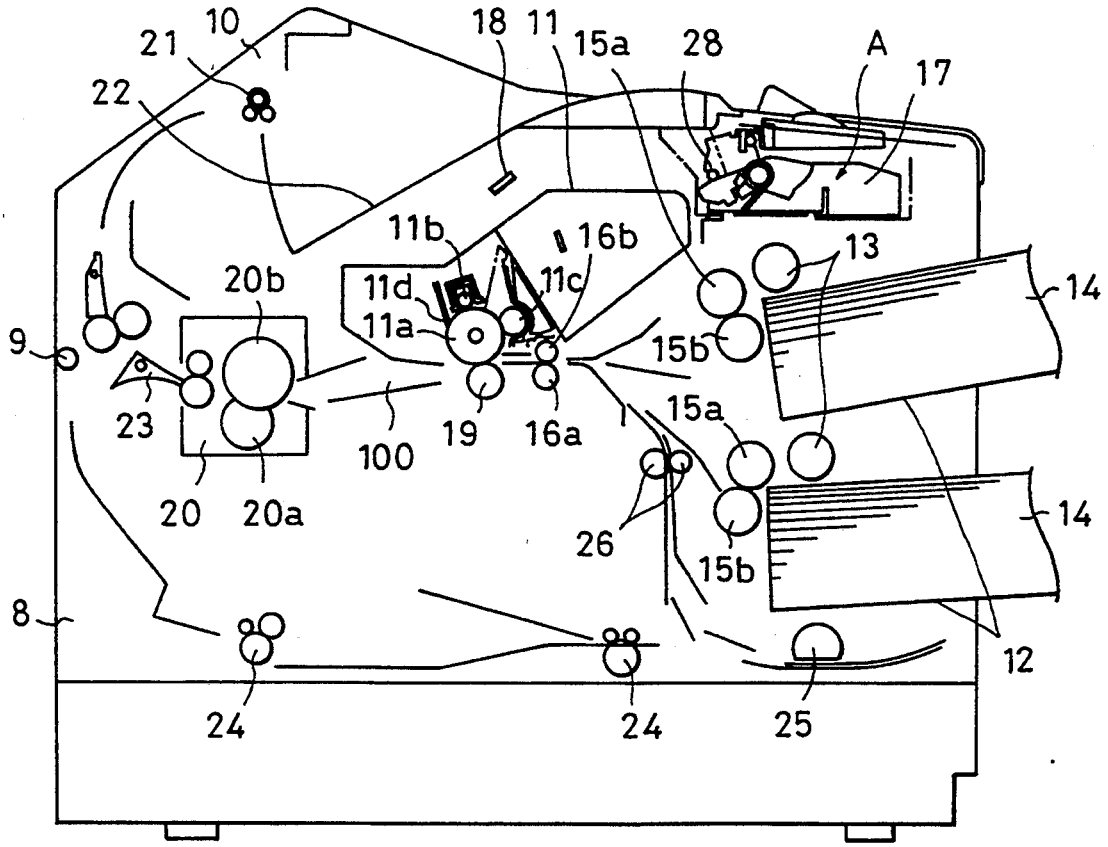
FIG. 8 is a schematic illustration of the overall construction of an image forming apparatus in accordance with a second embodiment of the present invention.

As shown in FIG. 8, the image forming apparatus is designed to form an image, in which apparatus a lid 10 is rotatably mounted in the main body 8 of the apparatus around a shaft 9, rotatable with a recording medium passage 100 as a boundary, and the lid 10 is opened or closed and a process cartridge 11 is installed. The lid 10 is locked by the locking mechanism A in a condition in which it is closed.

The overall construction of the image forming apparatus will be explained first with reference to FIG. 8. A recording medium 14 supplied by a supply roller 13 from either one of two cassettes 12 at the upper and lower stages is transported to a pair of registration rollers 16a and 16b by means of a transport roller 15a and a retard roller 15b for preventing double-transportation. The recording medium is transported so as to synchronize with the image formation operation by the process cartridge 11 by means of the pair of registration rollers 16*a* and 16*b*.

The process cartridge 11 has, around the photosensitive drum 11*a* which is an image carrier and rotates in the direction indicated by the arrow when forming an image, a charging roller 11*b* for uniformly charging the surface of the photosensitive drum 11*a*, a developing unit 11*c* for making a latent image visible, which image is obtained by exposing a laser light from a scanner 17 shown in FIG. 8 through a reflection mirror 18, and cleaning means 11*d* for removing toner remaining on a photosensitive drum 11*a* after the toner image is transferred to the recording medium 14.

The toner image formed by the process cartridge 11 is transferred to the recording medium 14 transported between the photosensitive drum 11*a* and the transfer roller 19 by means of the pair of registration rollers 16*a* and 16*b*. In the recording medium 14 on which the toner image has been transferred, when the recording medium passes through a fixing unit 20 formed of a driving roller 20*a* and a fixing roller 20*b* having heating means contained therein, heat and pressure are applied thereto, causing the toner image to be fixed. The recording medium 14 is ejected by means of a pair of ejection rollers 21, onto an ejection tray 22 formed in the lid 10.

When an image is formed on both surfaces of the recording medium 14, the recording medium 14 which has passed through the fixing unit 20 is guided to a pair of transport rollers 24 by means of a flapper 23 and switched back from the roller by a semilunar-shaped forward and reverse roller 25, and transported again to the registration rollers 16*a* and 16*b* by a pair of re-transport rollers 26. An image is formed on a second surface in the same manner as on the first surface and ejected onto the ejection tray 22.

Next, the construction of the locking mechanism A for locking the lid 10 of the image forming apparatus to the main body 8 of the apparatus will be explained. The locking mechanism A is disposed in the inside of the main body of the image forming apparatus between both side walls, that is, the inside of the side walls in the back portion and the foreground portion, which is parallel to the shaft of the photosensitive drum 11*a*, as shown in FIG. 9.

Figure 9:
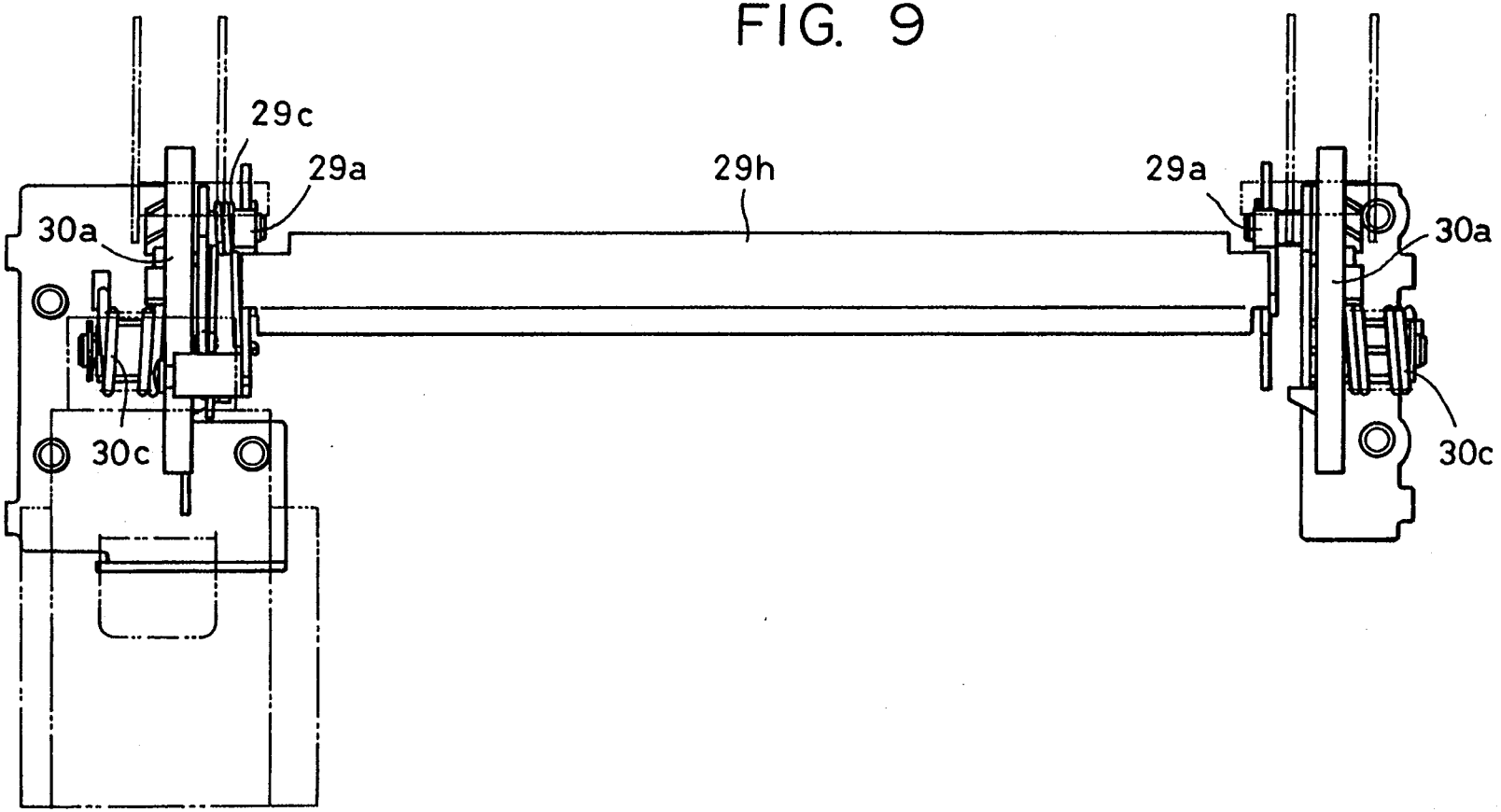
FIG. 9 is an illustration of a locking mechanism in the inside and between both side walls of the main body of the apparatus.
Figure 10:
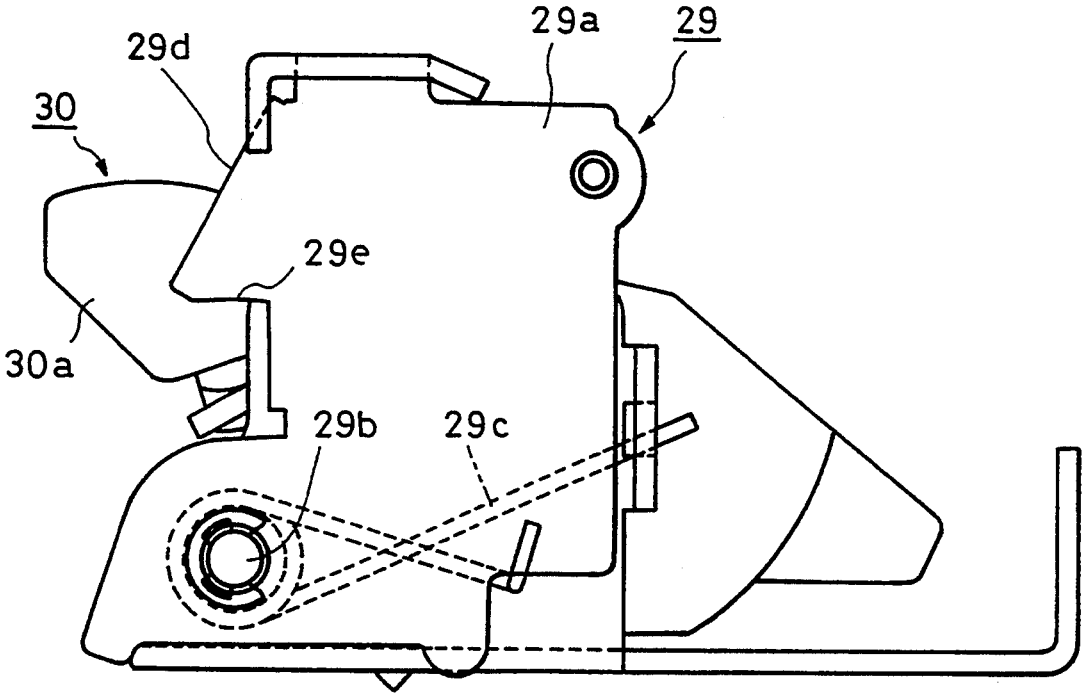
FIG. 10 is an illustration of the locking mechanism in accordance with the second embodiment of the present invention.
Figure 11:
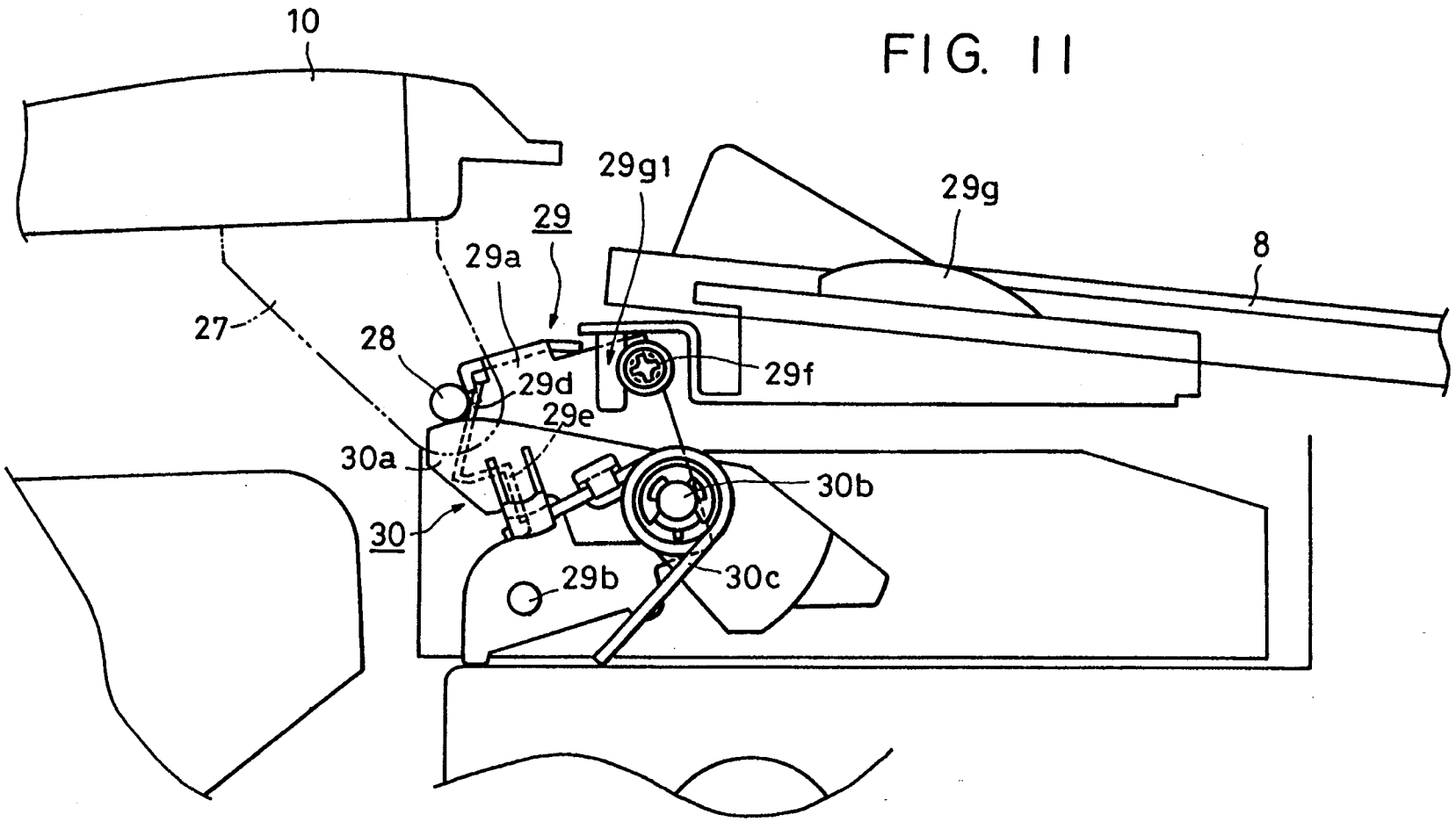
FIG. 11 is a sectional view schematically illustrating the locking mechanism in accordance with the second embodiment.

In FIGS. 9 to 11, in the lid 10, a lockable member 28 is mounted in a pair of side plates 27 mounted apart by a fixed distance. Locking means 29 and biasing means 30 are disposed in the main body 8 of the apparatus. A locking member 29*a* is mounted so as to be rotatable around a shaft 29*b* with respect to the main body of the apparatus. The locking member 29*a* is biased in a counterclockwise direction by means of a pressing spring 29*c* formed of a torsion spring mounted on the shaft 29*b*. An inclined section 29*d* which protrudes downward is formed in the locking member 29*a*, and a locking recess 29*e* is formed in the lower end of the inclined section 29*d*.

In the locking member 29*a*, as shown in FIG. 11, a projection 29*f* is formed in such a manner as to project inwardly of the apparatus, and a pin 29*g*1 of a lock releasing button 29*g* is locked to the projection 29*f*. Therefore, the locking member 29*a* will not rotate in a counterclockwise direction beyond the position shown in FIG. 11. When the lock releasing button 29*g* is made to slide to the right in FIG. 11, the locking member 29*a* rotates in a clockwise direction around the shaft 29*b*. The locking members 29*a* at both ends of and parallel to the shaft of the photosensitive drum (not shown in FIG. 11) are connected by means of a shaft 29*h* and moved in linkage with each other.

As shown in FIG. 11, a push-out member 30*a* is mounted in the biasing means 30 so as to be rotatable around a shaft 30*b*. The push-out member 30*a* is energized in a clockwise direction by means of a lifting spring 30*c* formed of a torsion spring. The push-out member 30*a* is designed so as not to rotate in a clockwise direction beyond the position shown in FIG. 11 by means of an unillustrated regulation member.

Next, an explanation will be given of a case in which the lid 10 is closed and locked to the main body 8 of the apparatus in the above-described construction.

Figure 12:
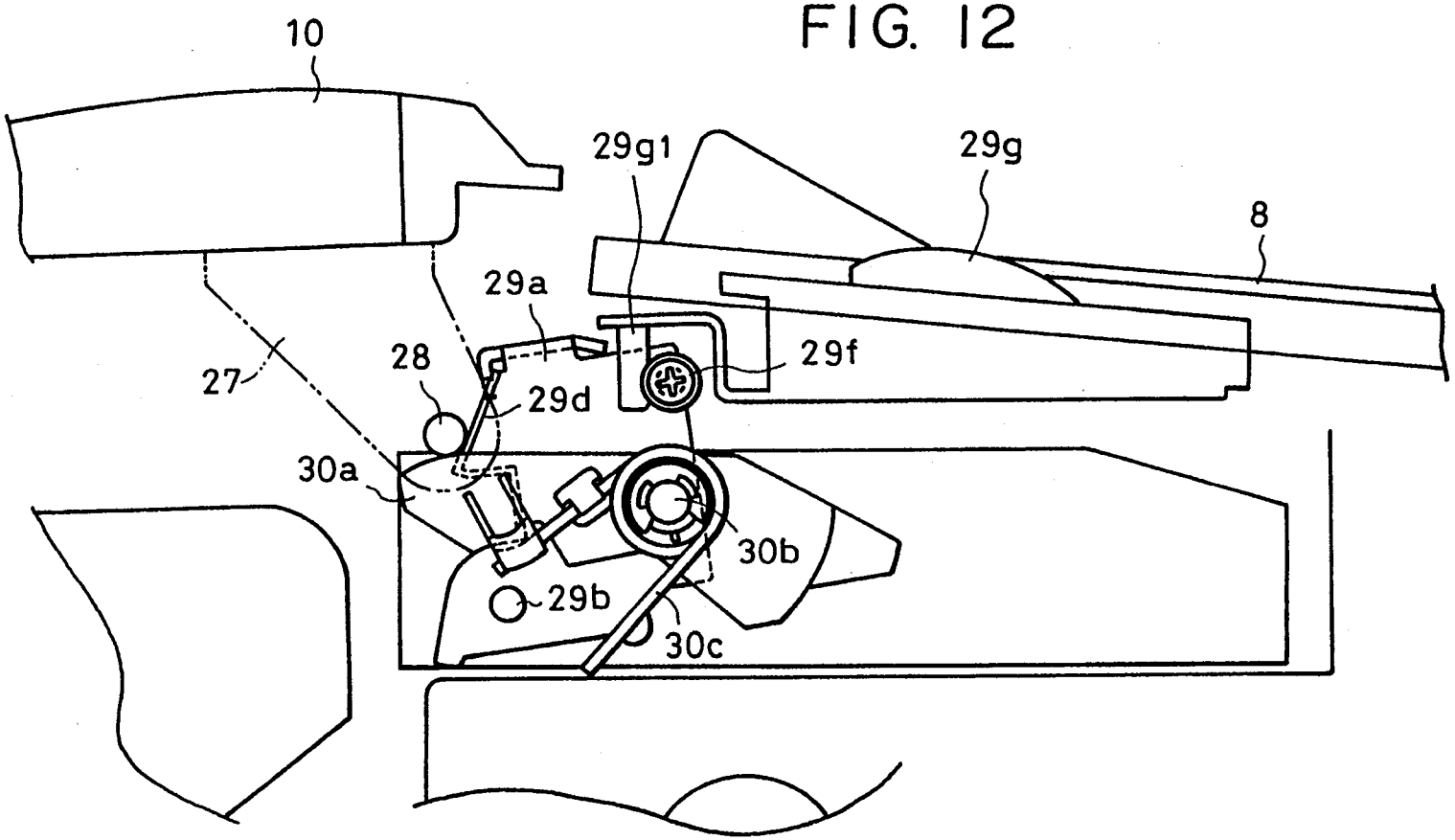
FIG. 12 is an illustration of a bar of the locking mechanism before it is locked to the locking member in accordance with the second embodiment.
Figure 13:
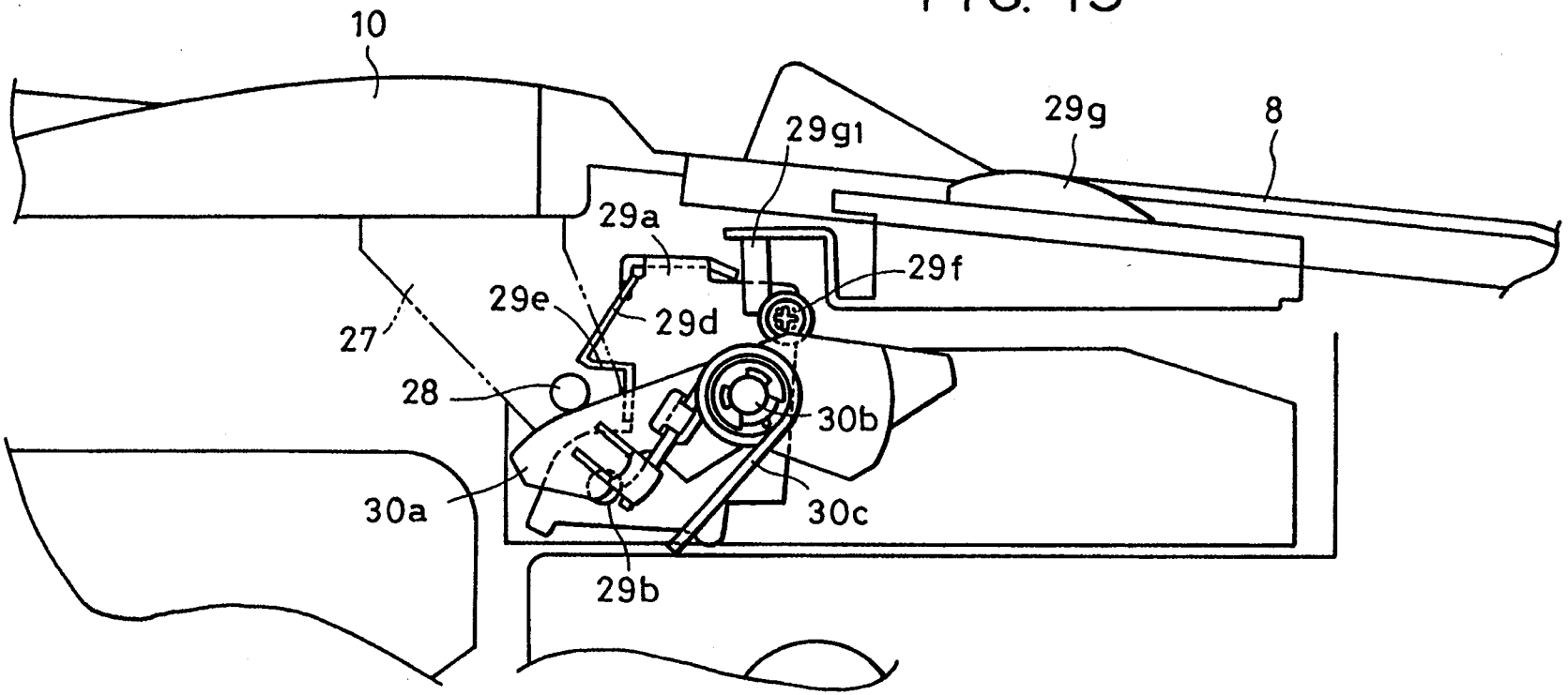
FIG. 13 is an illustration of the bar of the locking mechanism in an overstroke state in accordance with the second embodiment.
Figure 14:
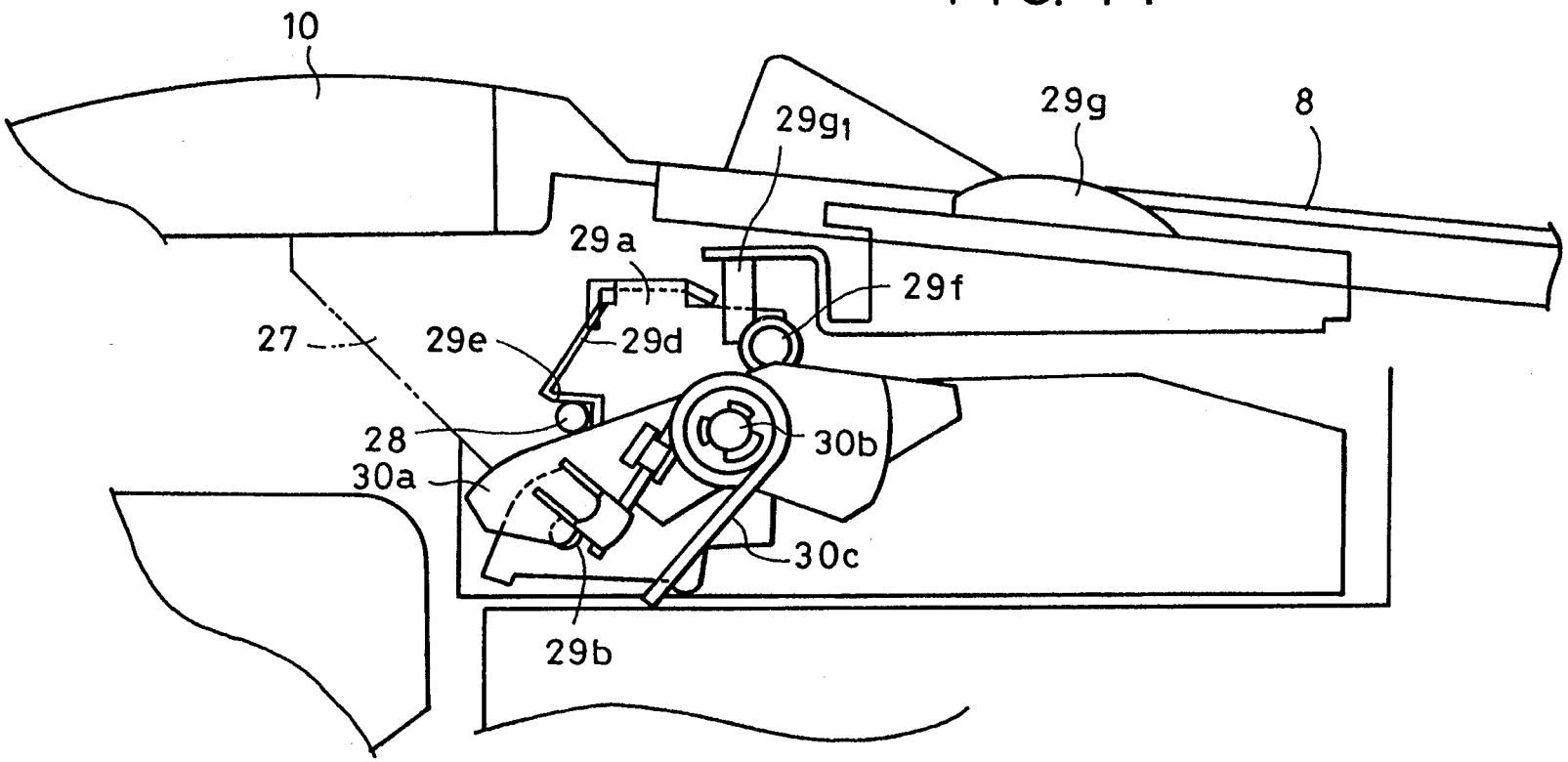
FIG. 14 is an illustration of the locking mechanism which is locked in accordance with the second embodiment.
Figure 15:
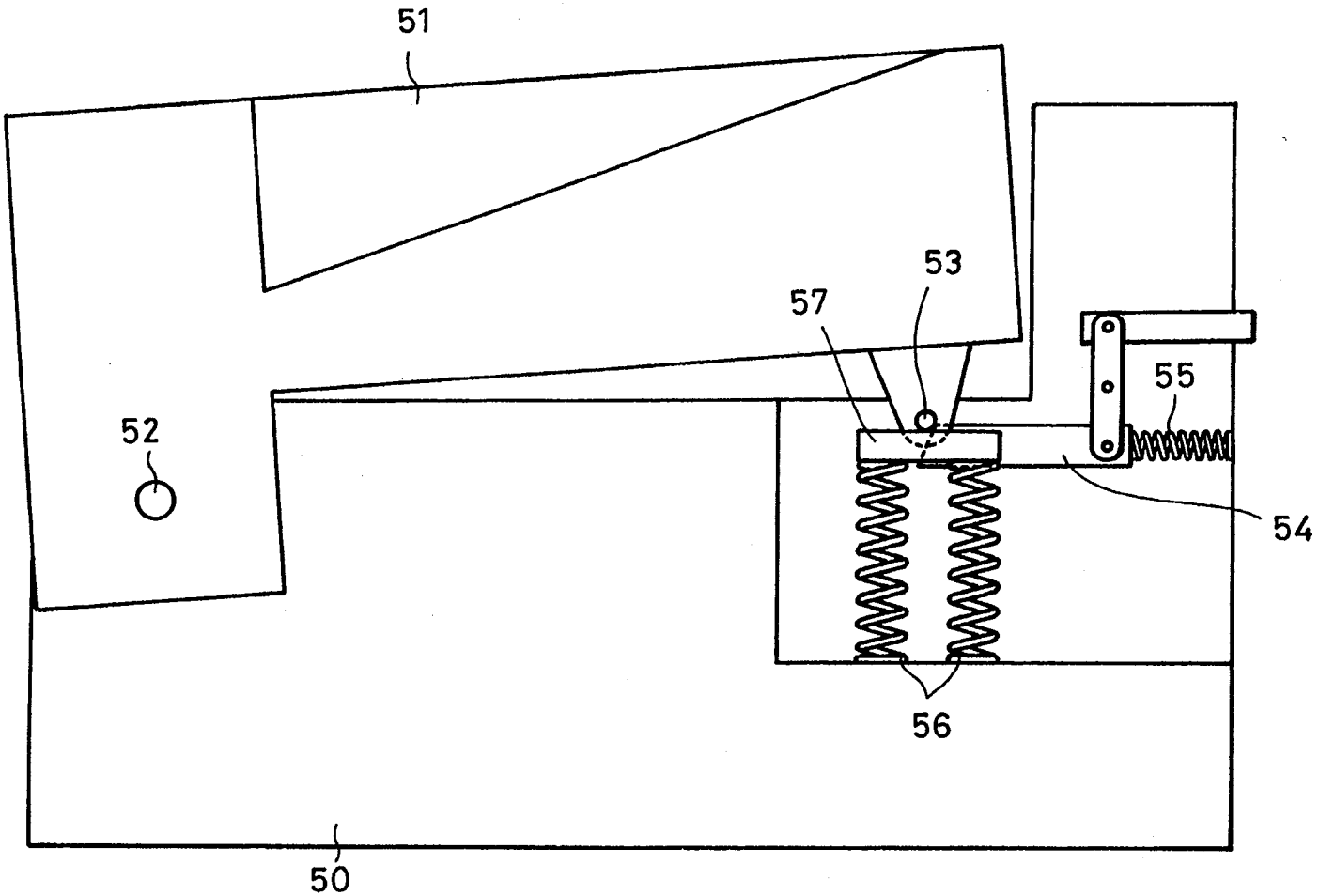
FIG. 15 is a sectional view illustrating problems caused when a lid member is locked to the main body of the apparatus.

Initially, as shown in FIG. 11, when the lid 10 is closed, the lockable member 28 rides on the push-out member 30*a* of the biasing means 30. When the lid 10 is pushed down in this condition, as shown in FIG. 12, the lockable member 28 pushes out the locking member 29*a* in a clockwise direction along the inclined section 29*d* and also pushes down the push-out member 30*a* in a counterclockwise direction. When the lid 10 is further pushed down, as shown in FIG. 13, the lockable member 28 travels beyond the inclined section 29*d* and overstrokes by a fixed amount below the lock position at which it is locked by the locking recess 29*e*, and the locking member 29*a* returns to its original position by the bias of the pressing spring 29*c*. Since the lid 10 cannot be pushed down beyond a given position (predetermined in accordance with the construction of the apparatus), the maximum distance of overstroke is fixed. When the pushing down of the lid 10 is stopped, as shown in FIG. 14, the lockable member 28 is pushed up by the push-out member 30*a* and locked to the upper end of the recess of the locking recess 29*e*.

When the lid 10 is pushed down and locked at this point, the lockable member 28 pushes out the locking member 29*a* in opposition to the bias of the pressing spring 29*c* and pushes out the push-out member 30*a* in opposition to the bias of the lifting spring 30*c*. That is, a force required to push down the lid 10 so as to lock the lid 10 in a condition in which the lockable member 28 is locked to the locking member 29*a* and the push-out member 30*a* is a resultant force $W_1+W_2$ of a push-out force $W_1$ by which the lid 10 is pushed up by the push-out member 30*a* and a component force $W_2$ (an upward component force as in $W_1$) perpendicular to the push-out force of the locking member 29*a*. The push-out force $W_2$ of the locking member 29*a* does not act in an overstroke condition in which the the lockable member 28 is positioned below the locking member 29*a*, and only the push-out force $W_1$ of the push-out member 30*a* acts.

Therefore, when the displacement of the lockable member 28 is plotted on the horizontal axis and the upward push-out force acting on the lockable member 28 is plotted on the vertical axis, the same relation as that of FIG. 7 shown with reference to the first embodiment is achieved.

Therefore, if the push-out force of the push-out member 30*a* at a position immediately before the lockable member 28 is locked by the locking member 29*a* (immediately before the locking of them is released) is denoted as $W_{1L}$, the push-out force of the push-out member 30*a* when the lockable member 28 displaces to the end portion of overstroke is denoted as $W_{1max}$, and the push-out force at a position immediately before the lockable member 28 is locked by the locking member 29*a* is denoted as $W_{2max}$, and if the forces are set so as to satisfy the relation $W_{1max}-W_{1L}<W_{2max}$, the same action as explained in the first embodiment occurs and the same effect can be obtained.

When the locking is released, the lock releasing button 29g may be made to slide to the right in FIG. 14 to release the locking of the locking recess 29e of the locking member 29a to the lockable member 28. In this case also, the lid 10 can be reliably pushed up to the position shown in FIG. 11 by the same action as in the first embodiment even if the weight of the lid 10 is large.

The above-mentioned process cartridge comprises an electrophotographic photosensitive material serving as an image carrier and at least one processing means. The arrangements of the process cartridge in addition to those of the above-described embodiment includes: an arrangement in which an image carrier and charging means are formed into one piece as a cartridge so as to be mounted in or removed from the main body of the apparatus; an arrangement in which an image carrier and developing means are formed into one piece as a cartridge so as to be mounted in or removed from the main body of the apparatus; an arrangement in which an image carrier and cleaning means are formed into one piece as a cartridge so as to be mounted in or removed from the main body of the apparatus; and an arrangement in which an image carrier and two or more processing means are combined and formed into one piece as a cartridge so as to be mounted in or removed from the main body of the apparatus, and the like.

Although in the above-described embodiment a laser beam printer has been shown as an image forming apparatus, the present invention is not limited to this printer. Needless to say, the present invention can be used in other image forming apparatuses, such as copying apparatuses.

According to the present invention, since an operational force becomes maximum immediately before the second frame is closed and locked to the lower frame in addition to it being required for the overstroke condition, only the force required as a lock operational force is provided, thus improving the ease of operation.

In addition, since the second frame is pushed out by the push-out force of the push-out means and the locking means when the locking is released, the second frame can be reliably pushed out even if the weight thereof is large, making it possible to easily confirm that locking has been released and to obtain a secure opening handhold.

Many different embodiments of the present invention may be constructed without departing from the spirit and scope of the present invention. It should be understood that the present invention is not limited to the specific embodiments described in this specification. To the contrary, the present invention is intended to cover various modifications and equivalent arrangements included within the spirit and scope of the claims. The following claims are to be accorded a broad interpretation, so as to encompass all such modifications and equivalent structures and functions.

What is claimed is:

1. An image forming apparatus, comprising:

a casing including an openable and closable member movable relative to a fixed part of said casing;

biasing means for elastically biasing said openable and closable member, by exerting a biasing force, in a direction in which it is open relative to said fixed part; and latching means for latching said openable and closable member to said casing, said latching means elastically biasing said openable and closable member, by exerting a biasing force, in a direction in which it is open when said openable and closable member is closed relative to said fixed part of said casing, and said openable and closable member being latched by said latching means at a latch position after said openable and closable member is closed in opposition to the biasing forces of said biasing means and said latching means, wherein a following relationship is satisfied:

$$W_{1MAX}-W_{1L}<W_{2MAX}$$

when the biasing force of said biasing means and the biasing force of said latching means immediately before said openable and closable member is latched by said latching means are denoted as $W_{1L}$ and $W_{2MAX}$, respectively, and the biasing force of said biasing means at a position at which said openable and closable member travels beyond the latch position to a point where said openable and closable member can no longer travel is denoted as $W_{1MAX}$.

2. An image forming apparatus according to claim 1, wherein said biasing means and said latching means move in response to an operation for closing said openable and closable member, and said latching means returns to a same position as when said openable and closable member is open when said openable and closable member reaches the latch position.

3. An image forming apparatus according to claim 1, further comprising:

an image carrier;

charging means for supplying toner to said image carrier;

developing means for supplying toner to said image carrier; and cleaning means for removing toner remaining on the said image carrier, said image carrier, said charging means, said developing means and said cleaning means being attached to said openable and closable member.

4. An image forming apparatus according to claim 3, wherein said image carrier and at least one of said charging means, said developing means and said cleaning means is formed as an integral unit that is capable of being mounted in and removed from said openable and closable member at will.

5. An image forming apparatus according to claim 1, wherein said latching means is a locking means.

6. An image forming apparatus according to claim 5, wherein said locking means comprises a releasing button.

* * * * *

UNITED STATES PATENT AND TRADEMARK OFFICE

CERTIFICATE OF CORRECTION

PATENT NO. : 5,379,092

DATED : January 3, 1995

INVENTOR(S) : Takashima

It is certified that error appears in the above-indentified patent and that said Letters Patent is hereby corrected as shown below:

[57] ABSTRACT:

Line 8, "$W_{1MAX-w-}$" should read -- $W_{1MAX}$-W- --.

COLUMN 5:

Line 42, "$W_{1L+W2max}$" should read --$W_{1L}$+$W_{2max}$--.

COLUMN 10:

Line 42, "supplying toner to" should read --charging--; and
Line 46, "the" should be deleted.

Signed and Sealed this

Ninth Day of May, 1995

Bruce Lehman

*Attest:*

BRUCE LEHMAN

*Attesting Officer*

*Commissioner of Patents and Trademarks*